United States Patent [19]

Kyono et al.

[11] Patent Number: 4,541,903

[45] Date of Patent: Sep. 17, 1985

[54] PROCESS FOR PREPARING ZN-FE BASE ALLOY ELECTROPLATED STEEL STRIPS

[75] Inventors: Kazuaki Kyono; Shigeo Kurokawa; Hajime Kimura; Toshio Irie; Takahisa Yoshihara; Akira Matsuda, all of Chiba, Japan

[73] Assignee: Kawasaki Steel Corporation, Kobe, Japan

[21] Appl. No.: 666,313

[22] Filed: Oct. 30, 1984

[30] Foreign Application Priority Data

Dec. 3, 1983 [JP] Japan ..... 58-228666

[51] Int. Cl.[4] ..... C25D 3/56; C25D 7/00

[52] U.S. Cl. ..... 204/28; 204/27; 204/44.2

[58] Field of Search ..... 204/44.2, 27, 28

[56] References Cited

U.S. PATENT DOCUMENTS 4,252,866 2/1981 Matsudo et al. ..... 428/659

4,407,899 10/1983 Hara et al. ..... 428/626

4,444,629 4/1984 Martin ..... 204/44.2

FOREIGN PATENT DOCUMENTS 110700 7/1983 Japan ..... 204/44.2

*Primary Examiner*—G. L. Kaplan

*Attorney, Agent, or Firm*—Young & Thompson

[57] ABSTRACT

Steel strips are electroplated with a Zn-Fe base alloy containing 10 to 30% by weight of iron in a chloride bath which contains zinc and ferrous chlorides to give a total concentration of zinc and ferrous ions of from 1.0 mol/l to the solubility limit with a weight ratio of $Fe^{2+}/Zn^{2+}$ between 0.10 and 0.35, and chloride ions in a total concentration of at least 6.0 mol/l under electrolytic conditions: pH 1.0–6.0, current density 80–200 $A/dm^2$, and relative flow velocity 30–200 m/min. The bath may further contain a polycarboxylic acid such as citric acid and a Zn-Fe-P alloy plating may be deposited when the bath further contains hypophosphorous acid.

21 Claims, 4 Drawing Figures

PROCESS FOR PREPARING ZN-FE BASE ALLOY ELECTROPLATED STEEL STRIPS

BACKGROUND OF THE INVENTION

This invention relates to a process for electroplating steel strips or sheets for the purpose of preparing corrosion resistant steel strips which can be easily worked and show good plating appearance as well as improved overall rust prevention in the presence of a paint film applied as an undercoat, and are particularly suitable for use in the manufacture of automobiles.

Among surface treated steel strips, zinc plated or galvanized steel has found the widest variety of applications, for example, in automobiles, electric appliances, building material and the like because of its improved rust prevention. Recently, a closer attention has been paid to the drawbacks of galvanized steel and it has been desired to obviate such drawbacks. More particularly, galvanized steel strips are less compatible with paint films in which blisters often occur to substantially impair the quality of coated steel. They have inferior corrosion resistance at joints such as hemmed joints whether or not they are coated with paint.

Galvannealed steel strips, on the other hand, have found a wide variety of applications such as in automobiles, electric appliances and the like because of their improved corrosion resistance after paint coating. However, since the galvannealed steel is prepared by hot dip galvanizing steel followed by a heat treatment, the quality of the product is limited to a certain extent. In addition the plated film which is hard and brittle often exfoliates into powdery pieces during working, giving rise to so-called powdering. Therefore, much attention has recently been paid to Zn-Fe alloy electroplated steel as surface-treated steel substituting for the conventional electro-galvanized and galvannealed steel because the former steel has a combination of the advantages of the latter materials. The preparation of Zn-Fe alloy electroplated steel strips is disclosed in Japanese Patent Application Kokai Nos. SHO 56-9386, 57-51283, 57-192284, 58-52493, and 57-200589, for example. Most of these methods use a sulphate bath. However, the use of a sulphate bath at a low pH of approximately 1.0 results in a cathode deposition efficiency as low as less than 70%, which makes bath control difficult and manufacturing costly. Further insoluble anodes of Pb alloy or the like must be used for industrial production rather than soluble anodes of zinc or the like, giving rise to some problems including formation of $Fe^{3+}$ ion through oxidation of $Fe^{2+}$ ion in the plating bath, contamination with impurities from the anodes (particularly, lead is known to give a substantial adverse effect even at several p.p.m.), and difficult bath control. These problems are extremely difficult and costly, if not impossible, to solve. In addition, sulfate baths offer a significantly lower electrical conductance than chloride baths, for example, a fraction of that of chloride baths in the case of zinc plating, and thus require a hinger plating voltage, and hence, higher electric power and rectifier capacity at the sacrifice of economy.

The use of chloride baths eliminates the above-mentioned problems and is thus believed to be greatly advantageous for preparing Zn-Fe alloy electroplated steel strips. Such methods using chloride baths are disclosed in Japanese Patent Application Kokai Nos. SHO 57-51283 and 57-200589, for example. However, none of these methods have been commercially successful as sulfate baths have not.

Investigating the electroplating of Zn-Fe alloy from chloride baths, we found the following problems. First, the desirable iron content in the range between 10% and 30% by weight, which ensures good performance, is substantially affected by plating current density and relative flow velocity. Prior art control techniques could not provide industrial production. The aforementioned prior art methods using chloride baths only disclose particular current densities and relative flow velocities, although steady operation is not expectable at such limited points. A second problem is the propensity of forming multi-phase platings containing an $\eta$ phase with iron contents in the range between 10% and 30%. The presence of $\eta$ phase leads to inferior corrosion resistance after painting. A third problem is the quality of platings themselves which tend to be non-uniform and show poor appearance with a blackish gray color. A fourth problem is the poor adhesion of plated films resulting in exfoliation of plated films during working. Therefore, there is the need for an improved Zn-Fe alloy electroplating process capable of obviating these problems.

SUMMARY OF THE INVENTION

It is, therefore, an object of the present invention to provide an improved chloride bath for use in electroplating steel strips with Zn-Fe base alloys which is easy to control and permits a zinc-iron base plating to firmly bond to the underlying steel.

Another object of the present invention is to provide an improved process for electroplating steel strips with Zn-Fe base alloys in a steady manner.

According to a first aspect of the present invention there is provided a process for preparing a Zn-Fe base alloy electroplated steel strip by electroplating a steel strip with a Zn-Fe base alloy containing 10 to 30% by weight of iron to form a Zn-Fe base alloy plating having improved surface properties, characterized in that the electroplating is conducted in a chloride bath which contains zinc and ferrous ions in a total concentration of from 1.0 mol/l to the solubility limit with a weight ratio of $Fe^{2+}/Zn^{2+}$ between 0.10 and 0.35, and chloride ions in a total concentration of at least 6.0 mol/l under electrolytic conditions: pH between 1.0 and 6.0, a current density between 80 and 200 $A/dm^2$, and a relative flow velocity between 30 and 200 m/min.

In one preferred embodiment, the chloride bath further contains 0.005 to 0.5 mol/l of a polycarboxylic acid or a salt thereof.

In another preferred embodiment, the chloride bath further contains 0.0005 to 0.05 mol/l of hypophosphorous acid or a salt thereof.

In a further preferred embodiment, the chloride bath contains both the polycarboxylic acid and hypophosphorous acid.

DETAILED DESCRIPTION OF THE INVENTION

The process for preparing Zn-Fe base alloy electroplated steel strips according to the present invention will be described in further detail.

Zn-Fe base alloy electroplating is conducted in a plating bath based on chlorides. A relatively large amount of at least one chloride may be added to the bath to increase the electric conductance thereof and to save electric power consumption as well as to achieve a consistent iron content in plated films. The chlorides which may be added include alkali metal chlorides such as KCl and NaCl, alkaline earth metal chlorides such as $CaCl_2$, and $MgCl_2$, and ammonium chloride ($NH_4Cl$).

The total concentration of $Zn^{2+}$ and $Fe^{2+}$ ions are kept in the range between 1.0 mol/l and the solubility limit. Burnt deposits on edges and a reduced cathode deposition efficiency often result from total concentrations of less than 1.0 mol/l, while solid precipitates formed in excess of the solubility limit offer no merit.

The pH of the bath is kept in the range between 1.0 and 6.0. Cathodic deposition efficiency uneconomically diminishes and plating solutions become more corrosive at pH of lower than 1.0, whereas Zn and Fe ions tend to precipitate in the form of hydroxides at pH in excess of 6.0.

The iron content in plated films of Zn-Fe base alloy is kept in the range between 10% and 30% by weight of the alloy. Plated films with iron contents of less than 10% by weight show properties similar to those of zinc and are inferior in both corrosion resistance and plating phase. With iron contents of more than 30% by weight, plated films deteriorates their sacrificial corrosion prevention, resulting in inferior corrosion resistance, typically red rust resistance.

Figure 1:
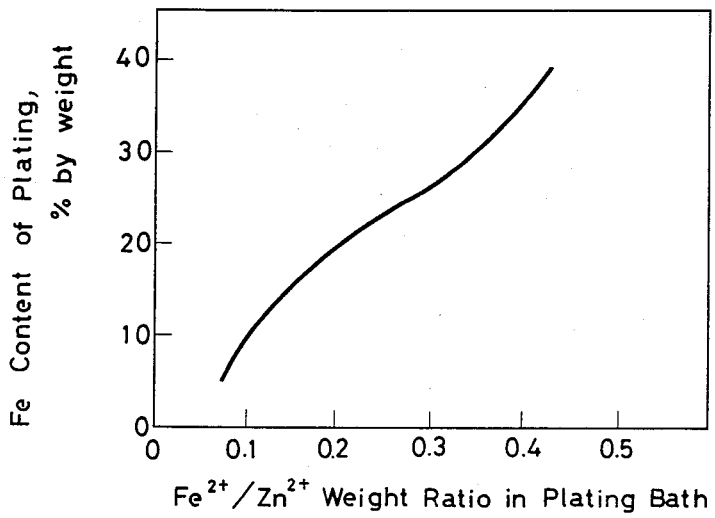
FIG. 1 is a diagram showing the iron content in plated films in relation to the weight ratio of $Fe^{2+}/Zn^{2+}$ in plating baths.

$Zn^{2+}$ and $Fe^{2+}$ ions may be introduced in the form of chloride, oxide, sulfate and the like. The iron content of plated films may be properly selected by controlling the ratio of $Zn^{2+}$ to $Fe^{2+}$ ions in the bath. To deposit films containing 10 to 30% by weight of iron in a steady manner, the weight ratio of $Fe^{2+}/Zn^{2+}$ in the bath should be kept in the range from 0.10 to 0.35. This limitation was derived by plating steel strips in chloride baths containing varying amounts of $ZnCl_2$ and $FeCl_2$ under conditions: pH of the plating solution between 2 and 4, a relative flow velocity of 60 m/min., and a current density of 100 A/dm$^2$. The results are plotted in FIG. 1, which is a graph showing the iron content of plated films in relation to the weight ratio of $Fe^{2+}/Zn^{2+}$ in the bath. As evident from FIG. 1, the iron content of plated films decreases to less than 10% by weight with weight ratios of $Fe^{2+}/Zn^{2+}$ of less than 0.1 whereas the iron content exceeds 30% by weight with weight ratios of $Fe^{2+}/Zn^{2+}$ in excess of 0.35.

Figure 2:
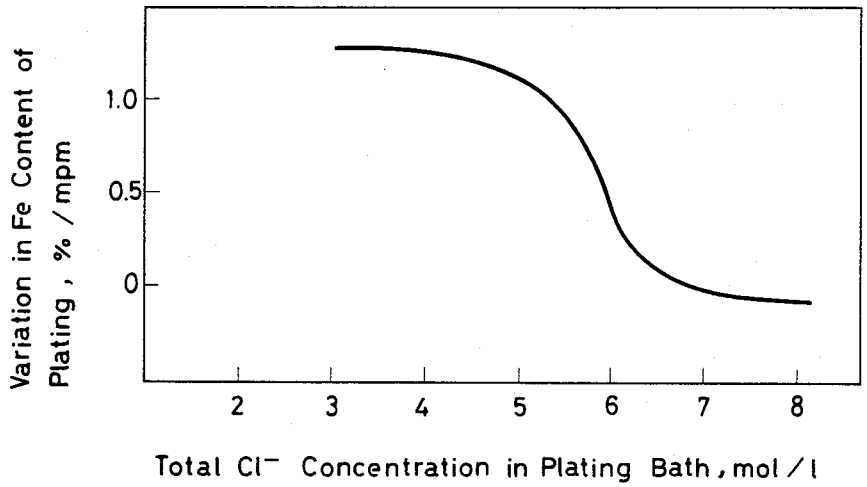
FIG. 2 is a diagram showing the variation of a predetermined iron content in plated films in relation to the total $Cl^-$ concentration in plating baths.

The total $Cl^-$ concentration in the bath should be kept from 6.0 mol/l, preferably from 7.0 mol/l to the solubility limit, the chloride ions being introduced as main ingredients such as zinc chloride and ferrous chloride and conductive aids and other additives in the form of chlorides. It was found through the following experiment that a consistent iron content was achieved in platings by increasing the total chloride ion concentration above a critical level. This limitation was determined by plating in chloride baths having varying total $Cl^-$ concentrations under plating conditions: pH 3.0 and current density 100 A/dm$^2$. FIG. 2 is a diagram in which the variation in the iron content (in the range of 10 to 30%) of plated films with relative flow velocity was plotted in relation to the total $Cl^-$ concentration. As apparent from FIG. 2, the iron content is unstable when the total $Cl^-$ concentration is less than 6.0 mol/l. To adjust the total concentration of $Cl^-$ ion in a bath to above 6.0 mol/l, conductive aids such as KCl, $NH_4Cl$, NaCl, $CaCl_2$ or the like alone or in admixture, and/or metal salts may be added in the form of chlorides.

The relative flow velocity used herein is the relative speed of travel of a steel strip through a plating bath and should be kept in the range between 30 and 200 meters per minute (mpm), and preferably between 50 and 150 mpm. Burnt deposits tend to form at edges with a relative flow velocity of less than 30 mpm, while plated films become unstable and turn gray in color when the relative flow velocity exceeds 200 mpm.

The current density should be kept in the range between 80 and 200 amperes per square decimeter, and preferably between 100 and 200 A/dm$^2$. This limitation was determined by plating steel strips in a chloride bath under conditions: pH 3.0, relative flow velocity 30 mpm and bath temperature 40° C. The adhesion of plated films to the underlying steel was evaluated at various iron contents of plated films and current densities. The results are plotted in FIG. 3, in which symbols have the following meanings and a solid line indicates the boundary between acceptable and rejected platings.

| Symbol | Plating adhesion |
|---|---|
| O: | excellent |
| Δ: | fair |
| X: | poor |

Figure 3:
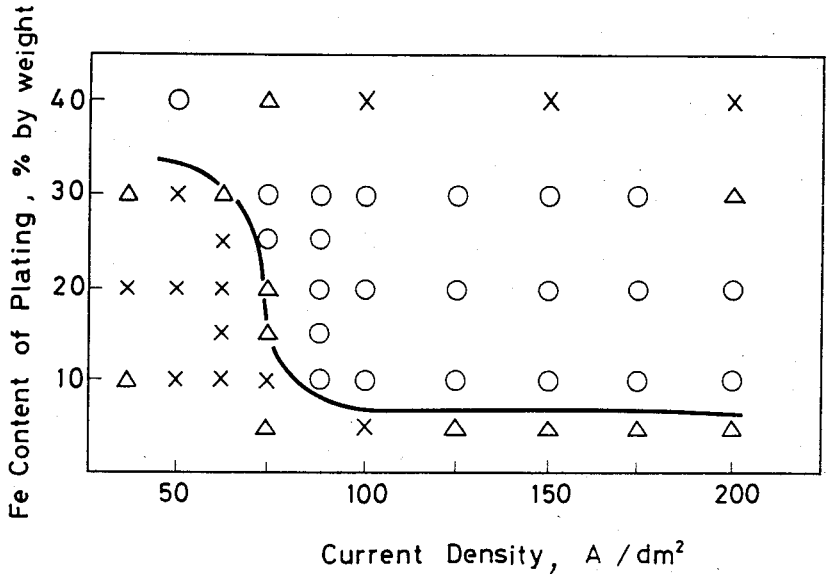
FIG. 3 is a diagram showing the degree of plating adhesion in relation to iron content in plated films and current density.

FIG. 3 shows that the plating adhesion become significantly poor as the current density decreased to less than 80 A/dm$^2$. It was found that plated films lustered in opaque white color and were free of $\eta$ phase on the higher current density side with respect to the boundary whereas plated films appeared whitish or blackish gray and contained $\eta$ phase on the lower current density side. The boundary in FIG. 3 is considered to be a critical curve of current density below which the $\eta$ phase will develop in deposits. Plated films containing $\eta$ phase are whitish or blackish gray and poor in adhesion, whereas plated films free of $\eta$ phase are opaque, white and lustrous and firmly bonded to the underlying steel.

Figure 4:
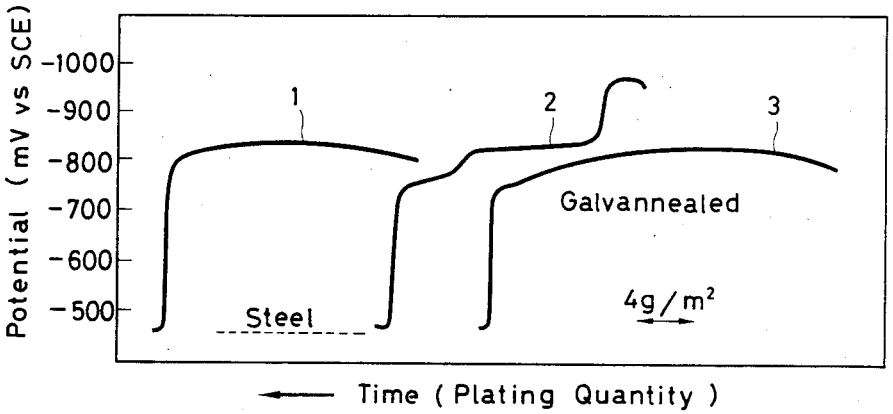
FIG. 4 is a diagram showing potential-to-time curves during galvanostatic anode dissolution of plated films.

FIG. 4 shows potential-to-time curves of the galvanostatic anodic dissolution of various Zn-Fe base alloy electroplated films. Galvanostatic anodic dissolution was conducted on plated films in an aqueous solution containing 100 g/l of $ZnSO_4 \cdot 7H_2O$ and 200 g/l of NaCl at 25° C. with a current density of 20 mA/cm$^2$. The variation of potential in millivolt (mV) vs. the saturated calomel electrode (SCE) with time is plotted, indicating the quantity of films plated. Curves in FIG. 4, as will be described hereinafter, are those of Zn-Fe base alloy electroplating. Zn-Fe-P base alloys will show similar propensity as disclosed in Japanese Patent Application No. 58-84587.

For curve 1 in FIG. 4 according to the present invention, plating was effected to a thickness of 20 g/m$^2$ in a bath containing 70 g/l of ferrous chloride ($FeCl_2 \cdot nH_2O$), 120 g/l of zinc chloride ($ZnCl_2$) and 300 g/l of ammonium chloride ($NH_4Cl$) under electrolytic conditions: pH 4.0, bath temperature 45° C., current density 130 A/dm$_2$, and relative flow velocity 80 mpm. The plated films contained 20% by weight of iron and appeared slightly white with a uniform gloss. For curve 2, plating was effected to a thickness of 20 g/m$^2$ in a bath containing 100 g/l of ferrous chloride ($FeCl_2 \cdot nH_2O$), 100 g/l of zinc chloride ($ZnCl_2$), 200 g/l of ammonium chloride ($NH_4Cl$), 15 g/l of sodium acetate ($CH_3COONa$), and 5 g/l of citric acid ($HOOC(HO)C(CH_2COOH)_2$) under electrolytic conditions: pH 3.0, bath temperature 50° C., current density 50 A/dm$^2$, and relative flow velocity 80 mpm. The plated films contained 30% by weight of iron and appeared deeply blackish gray. The bath composition and plating conditions used for curve 2 are outside the scope of the present invention because Fe/Zn is about 0.6 and current density is 50 A/dm$^2$. Curve 2 shows that electroplating at a lower current density results in the appearance of $\eta$ phase and hence, deteriorated adhesion, and that the plated film is a mixture of substantially three different phases. Curve 3 corresponds to a galvannealed steel strip prepared by ordinary galvanizing followed by a heat treatment according to a prior art. The coated films had a thickness of 20 g/m$^2$ and an iron content of about 10% and were substantially composed of $\delta_1$ phase.

As evident from the curves in FIG. 4, the present invention provides Zn-Fe base alloy deposits comprising substantially a single electrochemical phase, whose electrochemical properties are similar to those of galvannealed films. In the case of curve 2, not only mixed electrochemical phases are present, but also $\eta$ phase or an electrochemically inferior phase resembling pure zinc is imperatively developed in plated films. The influence of current density is the basic finding for the present invention which can produce steel strips having electroplated thereon a Zn-Fe base alloy film consisting essentially of a single electrochemical phase and offering excellent appearance and color and firmly bonded to the underlying steel. The same applies for Zn-Fe-P base alloys. Current densities exceeding 200 A/dm$^2$ undesirably require an increased voltage and result in burnt deposits at edges and streaks.

By carrying out the process under the above-specified conditions, there are obtained steel strips having a Zn-Fe base alloy electroplating which is free of $\eta$ phase, white and lustrous, and firmly bonded to the underlying steel. Zn-Fe base alloy electroplating solutions are unstable by nature, and $Fe^{2+}$ ions contained therein are readily oxidized to $Fe^{3+}$ ions. The inventors found that $Fe^{3+}$ ions in the plating solution change the properties of plated films resulting in pit formation and reduced gloss and alter appropriate plating conditions. Although it is not clearly understood why $Fe^{3+}$ ions adversely affect, the inventors found that such unstable factors can be eliminated by adding a polycarboxylic acid such as citric acid, tartaric acid, succinic acid, gluconic acid, malic acid, and malonic acid, or a polycarboxylate such as sodium, potassium and ammonium salts of the foregoing acids alone or in combination. Although the reason for this effect has not become clear, it is believed that a polycarboxylic acid or a salt thereof preferentially forms a chelate with $Fe^{3+}$ because of its high chelation constant with $Fe^{3+}$ than with other cations, thereby preventing $Fe^{3+}$ ions from forming a precipitate and keeping the amount of $Fe^{3+}$ ions dissolved at a constant level.

Ferrous ion in plating solutions has the essential propensity of being oxidized with oxygen in air to $Fe^{3+}$ ion. It is therefore preferred for stabilization of a plating solution to employ appropriate countermeasures such as removal of ferric hydroxide Fe(OH)hd 3 precipitate, bubbling of $N_2$ gas into the plating solution for suppressed oxidation, and reduction of $Fe^{3+}$ to $Fe^{2+}$ ions.

The amount of the polycarboxylic acids or salts thereof added should be kept in the range between 0.005 and 0.5 mol/l. The effect is too small to stabilize a plating solution when the amount of polycarboxylic acid or salt added is less than 0.005 mol/l. Amounts of polycarboxylic acid or salt added in excess of 0.5 mol/l result in a reduced cathode deposition efficiency.

Although the present invention is described in connection with the electroplating of steel strips with Zn-Fe alloys, the process of the invention may be applied to the electroplating of steel strips with Zn-Fe base alloys composed of three or more elements, that is, one or more elements combined with zinc and iron. Steel strips having plated films containing P, Ni, Co, Cr, Mn, Sn, Mo, W, B, Ti, V and the like in the form of oxide, hydroxide or chloride and accompanying impurities are included in the Zn-Fe base alloy electroplated steel strips of the present invention as long as the above-stated conditions are satisfied. Particularly, Zn-Fe-P alloy electroplated steel strips are disclosed in Japanese Patent Application No. 58-84587 as possessing a higher corrosion resistance than Zn-Fe alloy electroplated steel strips.

Zn-Fe-P base alloy electroplated steel strips may be easily prepared by adding 0.0005 to 0.05 mol/l of hypophosphorous acid or a salt thereof such as sodium hypophosphite $NaH_2PO_2 \cdot H_2O$ to a Zn-Fe alloy electroplating solution. The amount of phosphorus codeposited is too small with additive amounts of less than 0.0005 mol/l whereas burnt deposits as well as non-uniform films often form with additive amounts of more than 0.05 mol/l. Potassium hypophosphite and phosphorous acid are also contemplated.

In the present invention, a plating bath predominantly comprising chlorides is used in which a soluble anode is normally employed. Such a chloride bath undergoes little change in the concentration of metal ions and is easy to control. Further, the high chloride ion concentration of more than 6.0 mol/l offers a high electric conductance, and hence, a low electric resistance between electrodes, enabling economical operation with a high current density. The other great advantage that the chloride bath has over other plating baths such as sulfate and sulfamate baths is a higher cathode deposition efficiency of more than 90%. The chloride bath is thus believed to be the most economical bath composition.

Under the plating conditions as defined above, there are usually formed platings of 10 to 100 grams per square meter, and preferably 20–40 g/m$^2$.

The process of preparing steel strips having a Zn-Fe base alloy electroplated thereon according to the present invention will be described by way of illustration and not by way of limitation.

EXAMPLES

Steel strips were electroplated with various Zn-Fe base alloys, and more precisely Zn-Fe and Zn-Fe-P base alloys in chloride baths comprising mainly ferrous chloride ($FeCl_2 \cdot nH_2O$) and zinc chloride ($ZnCl_2$) and optionally, sodium hypophosphite and/or a polycarboxylic acid as listed in Table 1 under electrolytic conditions indicated in Table 1. The thus plated steel was examined for the properties of platings shown in Table 1. Plating adhesion and blister prevention were tested and evaluated as follows.

The anode used was a separate Zn-Fe electrode, the potential and plating time varied with current density, and all the platings were built up to 20 grams per square meter. For example, current conduction at 100 A/dm$^2$ for 7 seconds gave the 20 g/m$^2$ plating.

(1) Formation of $\eta$ phase

Galvanostatic anodic dissolution was conducted on platings to determine whether $\eta$ phase was formed or not.

(2) Plating adhesion

A plated steel sample was extruded 9 mm by an Erichsen machine before an adhesive tape was attached to the plated surface. The adhesive tape was removed to examine how the plating was peeled from the underlying steel.

O: no peeling

Δ: some peeling

X: considerable peeling.

(3) Blister prevention

A plated steel sample was phosphate treated (using trade name Bonderite # 3030), coated with a paint film of 20 μm thick by cathodic electrophoretic painting using Power-Top U-30 Gray, and subjected to a salt spray test according to JIS Z 2371 for 360 hours followed by an adhesive tape peeling test. Evaluation was made in terms of the length of a peeled piece of plating.

O: 0–2 mm

Δ: 2–10 mm

X: 10 mm or more.

As apparent from the data relating to the properties of platings shown in Table 1, the samples according to the present invention are improved over the comparative samples which do not satisfy at least one of the requirements of the present invention and the prior art galvannealed steel strip.

TABLE 1

| | Bath composition | | | | | | Plating conditions | |
|---|---|---|---|---|---|---|---|---|
| Example | $FeCl_2\ nH_2O$ (g/l) | $ZnCl_2$ (g/l) | Conductive aid (g/l) | | Additive (g/l) | | pH | Bath temperature (°C.) |
| 1 | 70 | 120 | $NH_4Cl$ | 300 | 0 | | 4.0 | 45 |
| 2 | 100 | 200 | $NH_4Cl$ | 300 | Ammonium citrate | 5 | 3.0 | 50 |
| 3 | 70 | 180 | KCl | 300 | Potassium citrate | 2 | 3.5 | 50 |
| 4 | 40 | 140 | KCl | 350 | 0 | | 5.1 | 45 |
| 5 | 100 | 180 | $CaCl_2$ | 200 | Citric acid | 5 | 1.3 | 60 |
| 6 | 80 | 140 | $NH_4Cl$ | 350 | 0 | | 2.0 | 50 |
| 7 | 60 | 140 | $NH_4Cl$ | 270 | Sodium hypophosphite | 0.5 | 5.0 | 50 |
| 8 | 100 | 160 | NaCl | 200 | Sodium tartrate | 3 | 3.1 | 60 |
| 9* | 100 | 200 | $NH_4Cl$ | 300 | Ammonium citrate | 5 | 3.0 | 50 |
| 10* | 100 | 100 | $NH_4Cl$ | 200 | Sodium acetate | 15 | 3.0 | 50 |
| | | | | | Citric acid | 5 | | |
| 11* | | | | | Galvannealed | | | |
| 12* | 70 | 120 | $NH_4Cl$ | 300 | 0 | | 4.0 | 45 |
| 13* | 70 | 180 | KCl | 300 | Potassium citrate | 2 | 3.5 | 50 |
| 14* | 90 | 180 | KCl | 150 | 0 | | 5.0 | 60 |
| 15 | 50 | 245 | KCl | 330 | Sodium hypophosphite | 1.5 | 2.0 | 50 |
| 16 | 60 | 225 | KCl | 350 | Sodium hypophosphite | 2.5 | 3.0 | 55 |
| | | | | | Potassium citrate | 10 | | |
| 17 | 90 | 200 | $NH_4Cl$ | 330 | Sodium hypophosphite | 0.7 | 3.3 | 45 |
| | | | | | Ammonium citrate | 8 | | |
| 18* | 80 | 180 | $NH_4Cl$ | 310 | Sodium hypophosphite | 10 | 3.5 | 50 |

| | Plating conditions | | Properties of Platings | | | | |
|---|---|---|---|---|---|---|---|
| Example | Flow velocity (mpm) | Current density (A/dm$^2$) | Fe content (%) | Appearance | $\eta$ phase | Adhesion | Blister prevention |
| 1 | 80 | 130 | 20 | semi-gloss | NO | O | O |
| 2 | 40 | 130 | 19 | semi-gloss | NO | O | O |
| 3 | 50 | 150 | 18 | gloss | NO | O | O |
| 4 | 100 | 80 | 15 | gloss | NO | O | O |
| 5 | 50 | 170 | 25 | gloss | NO | O | O |
| 6 | 150 | 100 | 30 | gloss | NO | O | O |
| 7 | 70 | 190 | 14 | semi-gloss | NO | O | O |
| | | | P 0.03 | | | | |
| 8 | 80 | 120 | 22 | gloss | NO | O | O |
| 9* | 40 | 70 | 19 | blackish gray | YES | X | Δ |
| 10* | 80 | 50 | 30 | blackish gray | YES | Δ | Δ |
| 11* | Galvannealed | | 10 | whitish gray | NO | Δ | O |
| 12* | 80 | 50 | 18 | gray | YES | Δ | Δ |
| 13* | 50 | 70 | 17 | gray | YES | X | Δ |
| 14* | 100 | 70 | 25 | gray | YES | Δ | Δ |
| 15 | 110 | 140 | 13 | gloss | NO | O | O |
| | | | P 0.08 | | | | |
| 16 | 170 | 160 | 19 | gloss | NO | O | O |
| | | | P 0.10 | | | | |
| 17 | 60 | 110 | 22 | gloss | NO | O | O |
| | | | P 0.04 | | | | |
| 18* | 120 | 100 | 18 | gloss | NO | X | O |
| | | | P 0.4 | partially non-uniform | | | |

*comparative examples

What is claimed is:

1. A process for preparing a Zn-Fe base alloy electroplated steel strip by electroplating a steel strip with a Zn-Fe base alloy containing 10 to 30% by weight of iron to form a Zn-Fe base alloy plating having improved surface properties, characterized in that the electroplating is conducted in a chloride bath which contains zinc and ferrous ions in a total concentration of from 1.0 mol/l to the solubility limit with a weight ratio of $Fe^{2+}/Zn^{2+}$ between 0.10 and 0.35, and chloride ions in a total concentration of at least 6.0 mol/l under electrolytic conditions: pH between 1.0 and 6.0, a current density between 80 and 200 $A/dm^2$, and a relative flow velocity between 30 and 200 m/min.

2. The process according to claim 1 wherein the chloride bath further contains 0.005 to 0.5 mol/l of a polycarboxylic acid or a salt thereof.

3. The process according to claim 2 wherein the polycarboxylic acid or salt thereof is selected from the group consisting of citric acid, tartaric acid, succinic acid, gluconic acid, malic acid, malonic acid, and salts thereof with sodium, potassium and ammonium and mixtures thereof.

4. The process according to claim 1 wherein the bath contains zinc and chloride ions in the form of zinc chloride.

5. The process according to claim 1 wherein the bath contains ferrous and chloride ions in the form of ferrous chloride.

6. The process according to claim 1 wherein the bath further contains a conductive aid.

7. The process according to claim 6 wherein the conductive aid is selected from the group consisting of alkali metal chlorides, alkaline earth metal chlorides, and ammonium chloride.

8. The process according to claim 1 wherein the current density is in the range between 100 and 200 $A/dm^2$.

9. The process according to claim 1 wherein the relative flow velocity is in the range between 50 and 150 m/min.

10. The process according to claim 1 wherein the total chloride ion concentration is at least 7.0 mol/l.

11. A process for preparing a Zn-Fe base alloy electroplated steel strip by electroplating a steel strip with a Zn-Fe base alloy containing 10 to 30% by weight of iron to form a Zn-Fe base alloy plating having improved surface properties, characterized in that the electroplating is conducted in a chloride bath which contains zinc and ferrous ions in a total concentration of from 1.0 mol/l to the solubility limit with a weight ratio of $Fe^{2+}/Zn^{2+}$ between 0.10 and 0.35, chloride ions in a total concentration of at least 6.0 mol/l, and 0.0005 to 0.05 mol/l of hypophosphorous acid or a salt thereof under electrolytic conditions: pH between 1.0 and 6.0, a current density between 80 and 200 $A/dm^2$, and a relative flow velocity between 30 and 200 m/min., thereby depositing a Zn-Fe-P alloy plating.

12. The process according to claim 11 wherein the hypophosphorous acid salt is selected from the group consisting of sodium hypophosphite and potassium hypophosphite.

13. The process according to claim 11 wherein the chloride bath further contains 0.005 to 0.5 mol/l of a polycarboxylic acid or a salt thereof.

14. The process according to claim 13 wherein the polycarboxylic acid or salt thereof is selected from the group consisting of citric acid, tartaric acid, succinic acid, gluconic acid, malic acid, malonic acid, and salts thereof with sodium, potassium and ammonium and mixtures thereof.

15. The process according to claim 11 wherein the bath contains zinc and chloride ions in the form of zinc chloride.

16. The process according to claim 11 wherein the bath contains ferrous and chloride ions in the form of ferrous chloride.

17. The process according to claim 11 wherein the bath further contains a conductive aid.

18. The process according to claim 17 wherein the conductive aid is selected from the group consisting of alkali metal chlorides, alkaline earth metal chlorides, and ammonium chloride.

19. The process according to claim 11 wherein the current density is in the range between 100 and 200 $A/dm^2$.

20. The process according to claim 11 wherein the relative flow velocity is in the range between 50 and 150 m/min.

21. The process according to claim 11 wherein the total chloride ion concentration is at least 7.0 mol/l.

* * * * *